US007732036B2

(12) United States Patent
Etchells

(10) Patent No.: US 7,732,036 B2
(45) Date of Patent: Jun. 8, 2010

(54) SHAPED ABSORBENT PADS

(75) Inventor: Marc D. Etchells, Florence, MA (US)

(73) Assignee: Paper-Pak Industries, LaVerne, CA (US)

( * ) Notice: Subject to any disclaimer, the term of this patent is extended or adjusted under 35 U.S.C. 154(b) by 69 days.

(21) Appl. No.: 10/802,254

(22) Filed: Mar. 17, 2004

(65) Prior Publication Data

US 2004/0267223 A1 Dec. 30, 2004

Related U.S. Application Data

(60) Provisional application No. 60/455,305, filed on Mar. 17, 2003.

(51) Int. Cl.

| | |
|---|---|
| ***B32B 1/04*** | (2006.01) |
| ***B32B 3/02*** | (2006.01) |
| *A61F 13/15* | (2006.01) |
| *A61F 13/20* | (2006.01) |

(52) U.S. Cl. ..... 428/76; 604/385.01

(58) Field of Classification Search ..... 604/358, 604/361, 358.01, 385.201; 428/72–76
See application file for complete search history.

(56) References Cited

U.S. PATENT DOCUMENTS

| | | | | |
|---|---|---|---|---|
| 4,048,361 | A * | 9/1977 | Valyi | 215/12.2 |
| 4,224,366 | A | 9/1980 | McCabe, Jr. | |
| 4,260,311 | A | 4/1981 | Hanses | |
| 4,382,507 | A | 5/1983 | Miller | |
| 4,619,361 | A | 10/1986 | Thomas, Jr. | 206/204 |
| 4,633,533 | A * | 1/1987 | Meehan | 4/222 |
| 4,756,939 | A | 7/1988 | Goodwin | |
| 4,873,101 | A | 10/1989 | Larson et al. | |
| 4,929,480 | A | 5/1990 | Midkiff et al. | |
| 4,935,276 | A | 6/1990 | Pawlowski et al. | |
| 4,940,621 | A | 7/1990 | Rhodes et al. | |
| 5,022,945 | A | 6/1991 | Rhodes et al. | |
| 5,041,325 | A | 8/1991 | Larson et al. | |
| 5,055,332 | A | 10/1991 | Rhodes et al. | |
| 5,093,176 | A * | 3/1992 | Pribonic et al. | 428/76 |
| 5,176,930 | A | 1/1993 | Kannankeril et al. | |
| 5,194,315 | A | 3/1993 | Itoh | |
| 5,275,591 | A * | 1/1994 | Mavinkurve | 604/387 |
| 5,320,895 | A * | 6/1994 | Larsonneur et al. | 428/137 |
| 5,382,467 | A | 1/1995 | Widlund et al. | |
| 5,428,346 | A | 6/1995 | Franklin | |

(Continued)

FOREIGN PATENT DOCUMENTS

| | | |
|---|---|---|
| WO | WO 92/18398 | 10/1992 |

OTHER PUBLICATIONS

Three dictionary definitions for polygon, http://www.OneLook.com (definitions from Encarta World English, Compact Oxford English and Cambridge International Dictionary of English online dictionaries).*

(Continued)

*Primary Examiner*—Melanie J Hand
(74) *Attorney, Agent, or Firm*—Ohlandt, Greeley, Ruggiero & Perle, L.L.P.

(57) ABSTRACT

There is provided an absorbent pad with contoured and/or complex shapes, and/or an absorbent pad having a single, double, or multi-layer islands. There is also provided methods for manufacturing such absorbent pads.

5 Claims, 10 Drawing Sheets

U.S. PATENT DOCUMENTS

| | | | | |
|---|---|---|---|---|
| 5,964,741 | A | 10/1999 | Moder et al. | |
| 6,270,873 | B1 * | 8/2001 | Darnett | 428/76 |
| 6,391,806 | B1 | 5/2002 | Carson et al. | |
| 6,766,817 | B2 | 7/2004 | da Silva | 137/1 |
| 6,926,862 | B2 * | 8/2005 | Fontenot et al. | 422/5 |
| 2002/0127385 | A1 * | 9/2002 | Topolkaraev et al. | 428/315.5 |

OTHER PUBLICATIONS

European Search Report dated Jun. 14, 2007 from corresponding application 04757578.2-2124 (PCT/US2004008196).

* cited by examiner

SHAPED ABSORBENT PADS

RELATED APPLICATION

This application claims priority to an earlier provisional patent application bearing Ser. No. 60/455,305 filed on Mar. 17, 2003, the entire contents of which are incorporated by reference herein.

BACKGROUND OF THE INVENTION

1. Field of the Invention

The present invention relates to absorbent pads. More particularly, the present invention relates to absorbent pads having contoured and/or complex shapes.

2. Description of Related Art

An absorbent pad is used for a variety of purposes including food-packaging, medical absorbent, laboratory cleanup, transportation packaging and safety, and personal hygiene. One use of an absorbent pad in the food-packaging industry is for the absorption of fluids secreted from meat, poultry, seafood, and other food products.

Absorbent pads are generally square or rectangular with straight edges. The absorbent core material is often a single layer of cellulose fluff or airlaid non-woven cut into the square or rectangular shape. The absorbent core material can also have multiple layers of tissue combined and cut into the square or rectangular shape. However, certain absorbent packaging designs are best served with unique and complex absorbent structures. Therefore, there is a commercial need for absorbent pads that are of shapes other than square or rectangular to more precisely fit an array of packaging shapes and sizes.

In conventional absorbent pads, a layer of film, non-woven material, or paper is typically attached to the upper and/or lower surface of the absorbent core material by gluing essentially at least one side of the entire inner absorbent core surface and/or the outer edges using a hot-melt or cold liquid adhesive. The inner absorbent structure, or core, is cut with straight knifes into squares or rectangles, with the surrounding film, paper or nonwovens also cut with straight blades.

The absorbent core material typically has an amount of a superabsorbent polymer (SAP) in either granule or fiber format. The superabsorbent polymer expands greatly as it absorbs liquids, posing problems for absorbent pads. As the superabsorbent polymer expands, it exerts pressure on the outside layers of the pad and the seams sealing the upper and lower layers thereby creating a risk of bursting. It is important, particularly in the food-packaging industry, to keep the superabsorbent polymer inside the absorbent pad and away from the food product before and after the swelling of the superabsorbent polymer.

Another problem that arises with the high absorbent capacity of one or more superabsorbent polymers is the desiccation of food products within the packaging. Absorbent pads have been developed that use holes, slits, or microperforations in the top sheet of the absorbent pad to allow for effective fluid absorption while minimizing the drawing effect that causes the desiccation of the food product. U.S. Pat. No. 6,270,873 describes an absorbent pad with microperforations.

Often there is a need to deliver in the absorbent pad other components, such as active ingredients. These components typically perform better when allowed to remain dry, or at a minimum, not fully immersed or saturated with liquid. For example, an enzymatic oxygen scavenger, which is used to remove oxygen from the interior of food packages to provide improved shelf life and appearance, function best when dry or only damp. An absorbent pad that would allow for one or more of these components to be placed in a separate layer, portion, or zone from the absorbent core material is desirable.

There remains a commercial need for an absorbent pad that further minimizes the potential for bursting at the seams, while also providing multiple layers, portions, or zones for separating the absorbent core from other components. It would further be desirable to have an absorbent pad that has shapes other than square or rectangular.

SUMMARY OF THE INVENTION

It is an object of the present invention to provide an absorbent pad that can be manufactured in shapes other than a square and rectangle.

It is another object of the present invention to provide an absorbent pad with any contoured and/or complex shape.

It is still another object of the present invention to provide an absorbent pad that minimizes the risk of bursting caused by swelling of the absorbent core.

It is yet another object of the present invention to provide an absorbent pad with multiple layers, portions, and/or zones.

It is still yet another object of the present invention to provide methods for manufacturing an absorbent pad in any configuration including contoured and/or complex shapes.

It is a further object of the present invention to provide methods for manufacturing an absorbent pad with multiple layers, portions, and/or zones.

It is still a further object of the present invention to provide an absorbent pad that does not require any perforations to effect fluid flow into the absorbent pad.

It is another object of the present invention to provide an absorbent pad with two or more absorbent panels hingeably connected allowing for the folding of the panels.

These and other objects and advantages of the present invention are provided by an absorbent pad with one or more contoured and/or complex shapes, and a single, double or multi-layer island. The present invention also provides for methods for manufacturing such absorbent pads.

DETAILED DESCRIPTION OF THE INVENTION

The present invention provides an absorbent pad with one or more contoured and/or complex shapes. Preferably, the absorbent pad has one or more contoured and/or complex shapes. The present invention further provides an absorbent pad having a single, double or multi-layer "island." The present invention also provides for methods of manufacturing an absorbent pad with one or more contoured and/or complex shapes and for methods of manufacturing an absorbent pad having a single, double or multi-layer "island."

The contoured and/or complex shaped absorbent pads of the present invention can be manufactured in any shape or combination of shapes using straight, curved or a combination of straight and curved dimensions. Examples of possible shapes include, but are not limited to, round, oblong, extended rectangular, trapezoidal, triangular, donut-shape, cone and/or rod, and repeating arrangements of shapes or geometries. The absorbent pad itself, as well as the absorbent core material, can have any shape or combinations of shapes.

The size of the contoured and/or complex shaped absorbent pad can range from very small to very large. Typical sizes range from approximate dimensions of about 1" wide and about 1" long up to about 24" wide and about 42" long.

Figure 1:
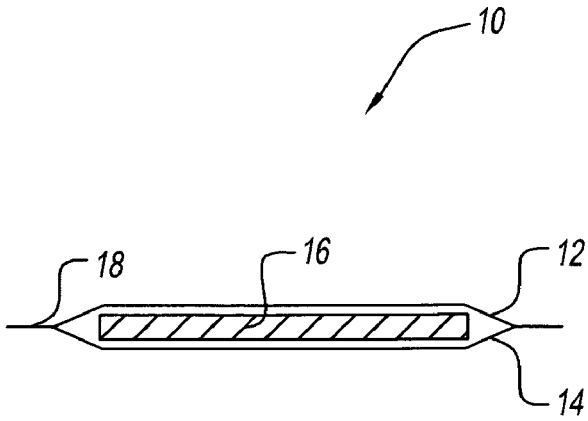
FIG. 1 is a side cut away view of an absorbent pad according to the present invention.
Figure 1A:
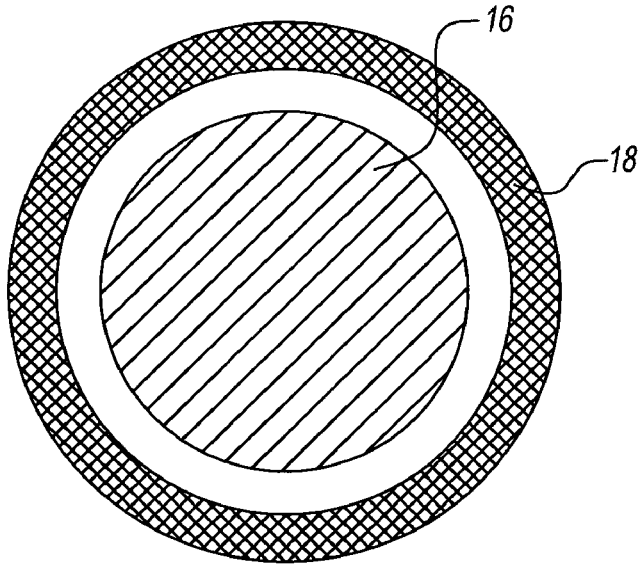
FIG. 1*a* is a top view of the absorbent pad depicted in FIG. 1.

Referring to FIGS. 1 and 1*a*, the absorbent pads of the present invention represented generally by reference number 10 typically have a top sheet 12 and a bottom sheet 14 with an absorbent core 16 therebetween. Top sheet 12 and bottom sheet 14 are the outer layers of absorbent pad 10 and can be film, non-woven, or paper. Top sheet 12 and bottom sheet 14 may be bonded together around a periphery 18 of the absorbent pad 10. Top sheet 12 can be micro-perforated or slit. Bottom sheet 14 can also be micro-perforated or slit. Either layer can be liquid impervious. Examples of appropriate films include, but are not limited to, polyethylene, polypropylene, polyester, or any combinations thereof.

Multiple materials can be used in either or both of top sheet 12 and bottom sheet 14 of absorbent pad 10. These multiple materials can be simply adjacent to each other and not bonded except in areas that are heat-sealed. They can also be adhered without adhesive lamination using static attraction and/or corona discharge. The multiple materials may be point bonded, pattern bonded, or intermittently bonded to each other using an about 5% to about 20% bond area to provide attachment but easy separation. Using point bonding and attachment of the multiple layers can provide that the bonding pattern perforates through the outer impermeable film to form a hole having the perimeter of the hole fused between outer and inner materials within the layer. This fusion of the perimeter of the hole provides strength, wicking, and added containment of the absorbent core. Point bonding, using an about 5% to about 20% bond area, of adjacent materials in the layer in a controlled manner allows for certain bonding areas with full penetration through the materials of the layer while providing simple mechanical attachment in other areas of the layer.

Top sheet 12 and/or bottom sheet 14 of absorbent pad 10 of the present invention can utilize between two and seven materials or layers. However, use of a single material is possible. A preferred material is a co-extruded film of between two and seven material layers. Generally, the interior layer of the multiple layers used is a heat-sealing layer, such as a low-melt polymer layer.

The outer layers can be of any thickness. Each outer layer is preferably between about 0.00075 inches and 0.003 inches in thickness. The outer layers can be natural or pigmented in any color. A preferred color is white. Printing is possible on either surface.

The absorbent core material can be any material suitable for absorbing liquids, particularly food-product liquids. Examples of suitable absorbing materials include, but are not limited to, superabsorbent polymer, compressed SAP composite of superabsorbent polymer granules adhered with one or more binders and/or plasticizers, compressed composite containing a percentage of short or microfiber materials, thermoplastic polymer fibers, thermoplastic polymer granules, cellulose powders, cellulose gels, an airlaid with superabsorbent, any fibrous or foam structure that has been coated or impregnated with a superabsorbent, absorbent structure having one or more starch or cellulose based absorbents, absorbent structure containing superabsorbent material formed and/or crosslinked in-situ, or any combinations thereof. Superabsorbent material can be used in various forms. Examples of suitable superabsorbent material forms include, but are not limited to, granular, fiber, liquid, superabsorbent hot melts, or any combinations thereof. Compressed composites of short and microfiber (from about 0.1 inches to about 0.3 inches in length) materials having between about 3% and about 25% short or micro-fiber content have been shown to strengthen the core for high speed processing but retain the desired properties of low cost and high speed absorption and wicking.

Figure 2:
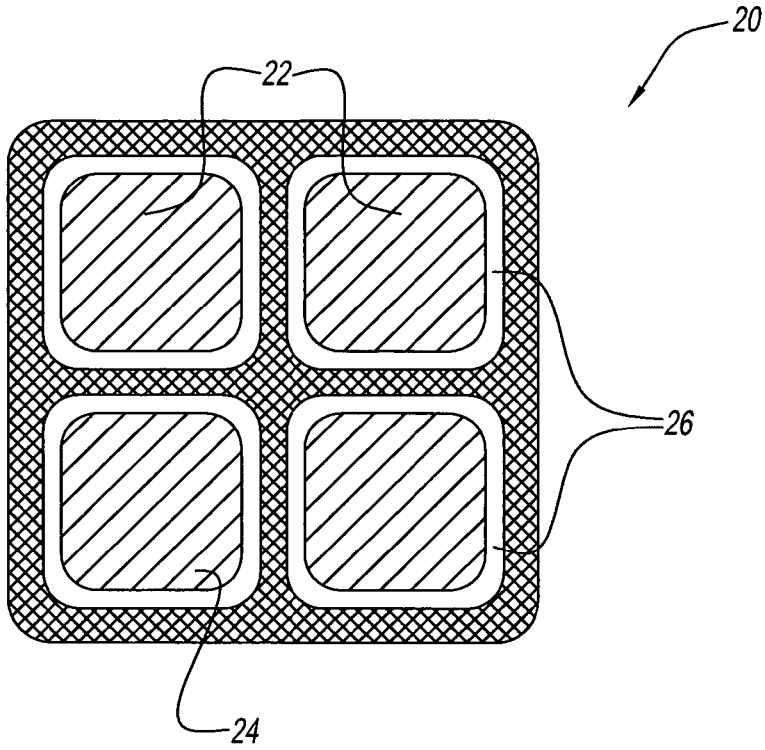
FIG. 2 is top view of an absorbent pad with multiple islands according to an embodiment of the present invention.

Referring to FIG. 2, contoured and/or complex shaped absorbent pad 20 can have one or more islands 22 dispersed throughout the pad. An island is a pocket created by the sealing of the top sheet and bottom sheet of the absorbent pad around absorbent core 24 or other enclosed material. The absorbent core material is in the pocket or island. Benefits of the island or pocket include the control of migration of the absorbent material throughout the pad and promoting integrity to the overall pad. Each island 22 generally has space 26 around the materials enclosed within, particularly in the case of absorbent material, to provide for expansion of the inner materials. The pockets or islands can contain more than one type of absorbent material and/or active component.

Each island may itself be a single, double, or multiple-layered island. In a single layer island, the absorbent core is within the pocket. The single layer absorbent core, as well as the pocket itself, can have any contoured and/or complex shape. The pocket and the material held within can be of different shapes. In a double layer island, there is another layer in addition to the absorbent core layer. This second layer can provide additional or improved functionality to the absorbent pad. Examples of additional layers are a wicking layer, transfer layer, active component (such as antimicrobial, oxygen scavenging, sanitizing) layer, or simply a layer to enhance the appearance. The second layer can have the same shape and size as the first absorbent core layer. However, the second layer can also have a different shape or size than the absorbent core layer. In a multiple layer island, additional layers are either of the same or different shape and size, to add even more functionality or improved performance to the absorbent pad.

The ability to assemble multiple layers or islands along with the potential to incorporate multiple layers of film, paper, nonwoven, etc. solves some difficult problems. For example, it is often desirable to utilize "active" components in the absorbent pad that impart value added features such as microbial control, sanitization, and atmospheric modification such as oxygen scavenging or ethylene emission. Suitable actives include, but are not limited to, one or more antimicrobial agents, sanitizing agents, oxygen scavengers, $CO_2$ emitters, ethylene scavengers, surface-active agents, and other "active" components that are biological or inert in nature, or any combinations thereof.

These "actives" are often composed of single or multiple component systems that need to be maintained in a protected manner either from other components in the system and/or oxygen in the atmosphere and/or moisture and then released or made available when the product is put into use as an absorbent. A solution is provided by using dissolving nonwovens or films to maintain isolation chambers within the pad from the atmosphere or other components. Several raw materials have proven effective as components in dissolving films including polyvinyl alcohol (PVA), chitosan, alginate, pectin, polyamide, cellulose and starches. The ideal materials will be flexible, safe for the ultimate application, heat, ultrasonic or RF sealable on at least one side, and dissolve in room temperature water. Dissolving paper containing conventional cellulose fibers and/or carboxymethyl cellulose (CMC) has also proven effective and can be further enhanced with the application of a film coating from the materials listed above.

Figure 3:
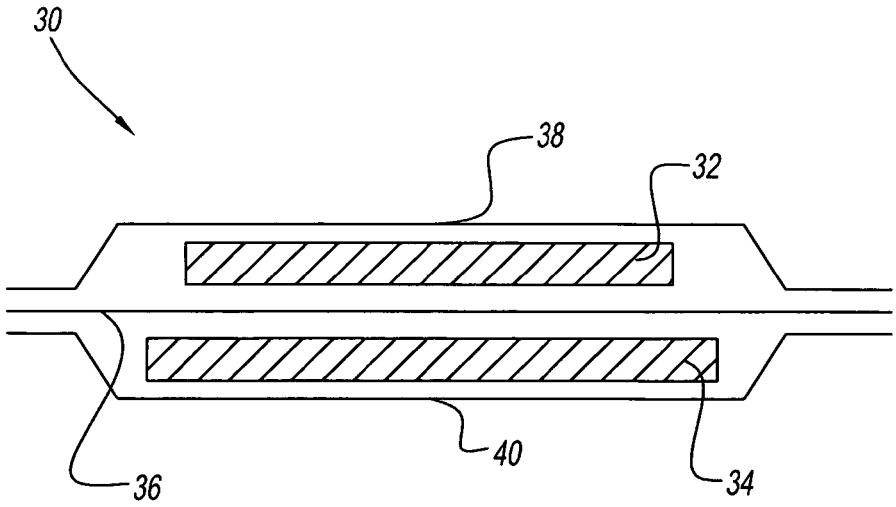
FIG. 3 is a side cut away view of an absorbent pad with two stacked islands according to an embodiment of the present invention.

Referring to FIG. 3, in a double or multiple layer island 30, the first layer 32 and second layer 34, contained between top sheet 38 and bottom sheet 40, can be separated by a film, paper, or non-woven layer 36. The film, paper, or non-woven layer can extend beyond the island layers to seal the individual island layers into separate pockets one on top of the other. These separate pockets within the same island can be used to separate the absorbent core from other materials, such as active agents, which perform better when dry.

The absorbent pad of the present invention can also have more than one island in the pad itself. The islands can be of the same or different contoured and/or complex shape. The islands can also be of the same or different size. Any combination of size and shape in the islands and the layers in each island is possible. These combinations allow for differing islands to also have different contents in the pouch. For example, an absorbent pad can have absorbent core material in one or more of the islands and an oxygen scavenger in one or more of the other islands. This separation from the absorbent material allows for improved performance of the oxygen scavenger while remaining dry.

Figure 4:
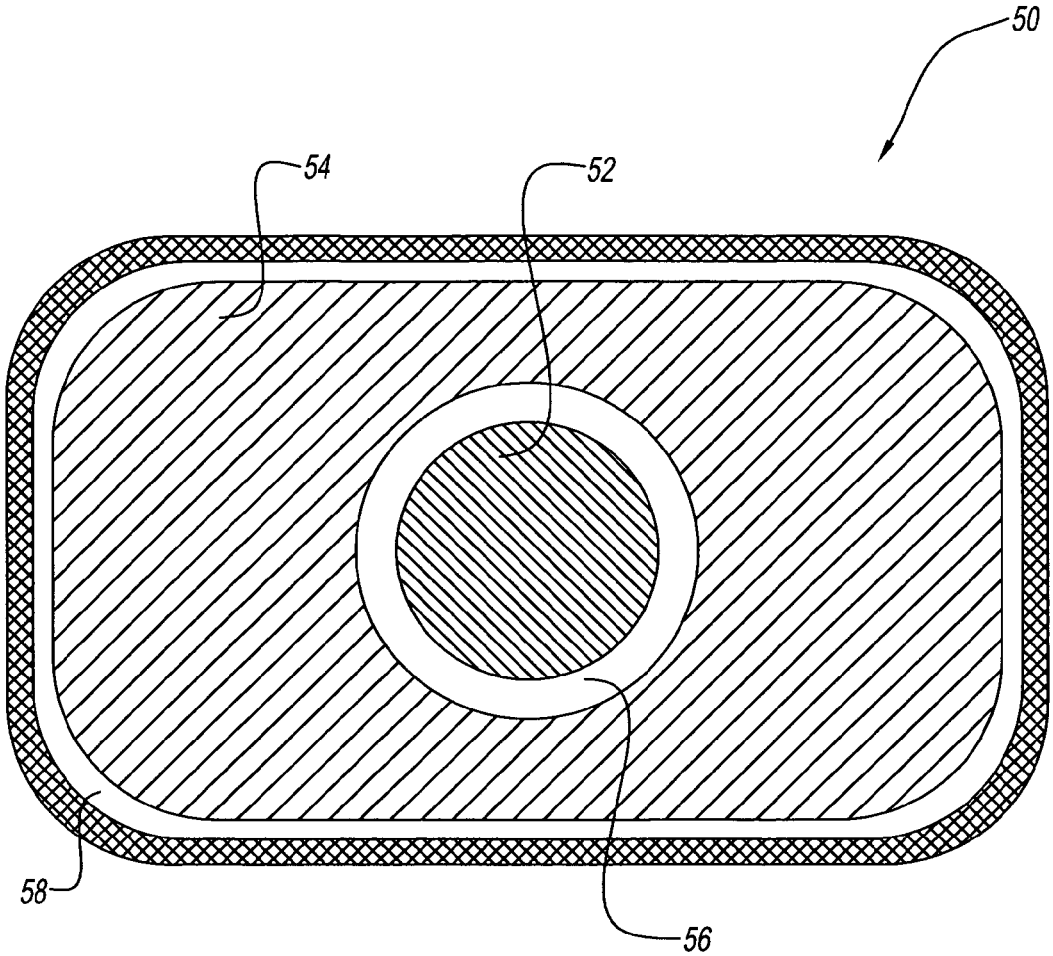
FIG. 4 is a top view of an absorbent pad with two islands of differing shape according to an embodiment of the present invention.

Referring to FIG. 4, an example of an absorbent pad with multiple islands is depicted. Absorbent pad 50 is shown with first island 52 and second island 54. Spaces 56 and 58 allow each island to expand.

Figure 5:
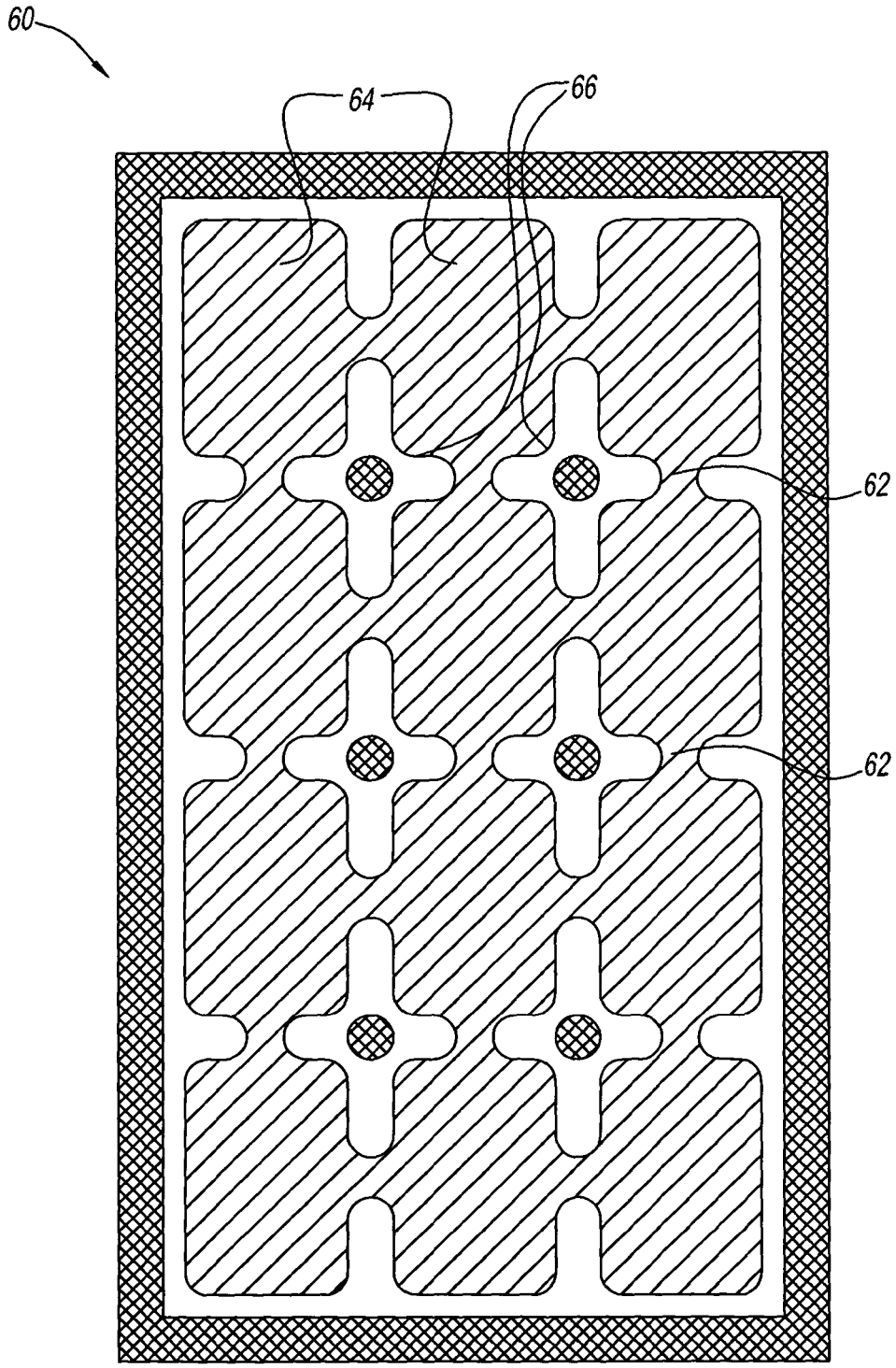
FIG. 5 is a top view of an absorbent pad with multiple connected islands according to an embodiment of the present invention.

Referring to FIG. 5, it is also possible for absorbent pad 60 to have one or more connections or channels 62 between islands 64 to allow controlled fluid flow and/or wicking between the islands. To form the channels 62, internal bonding 66 between the top sheet and bottom sheet can be done.

Figure 6:
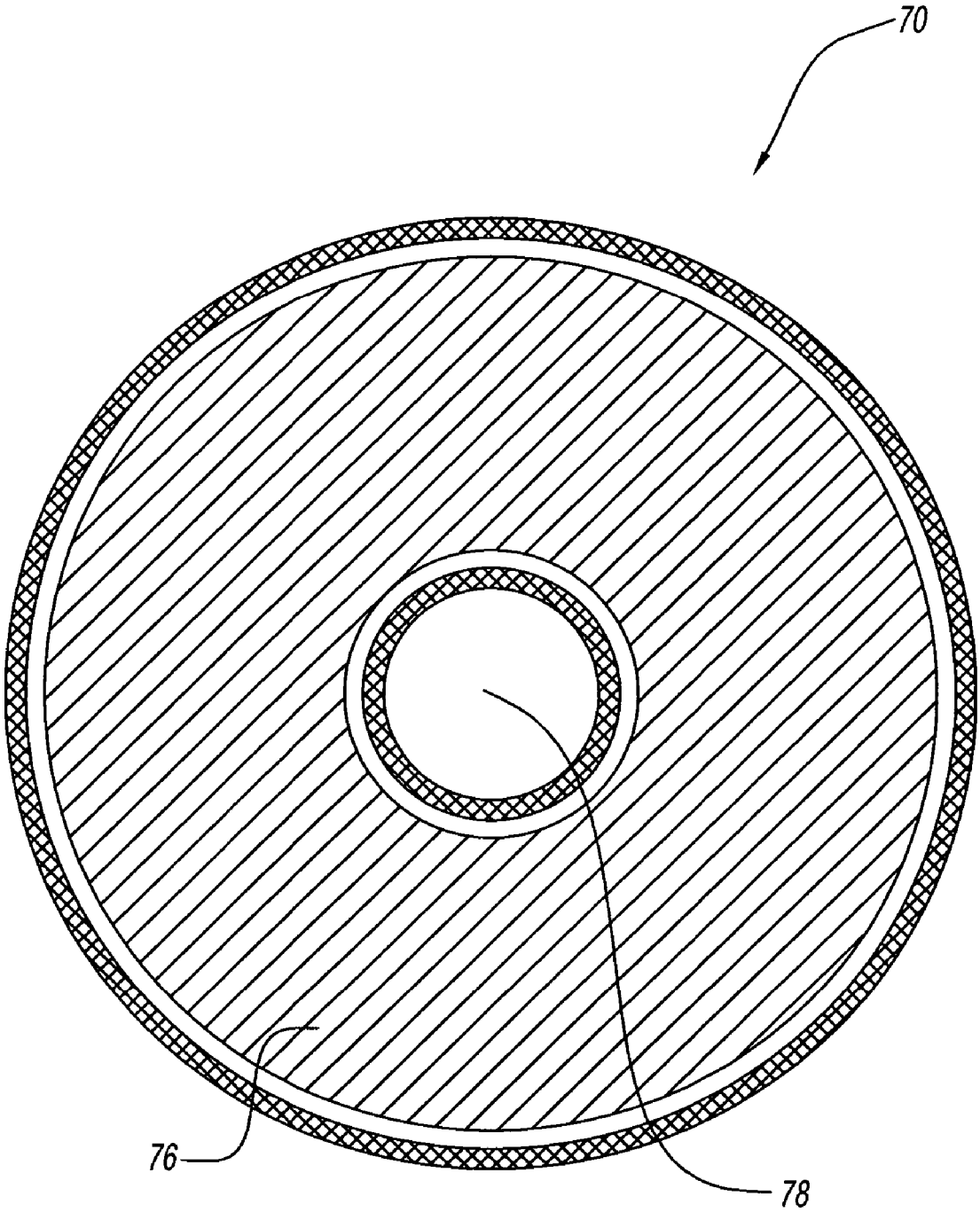
FIG. 6 is top view of a donut-shaped absorbent pad according to an embodiment of the present invention.
Figure 6A:
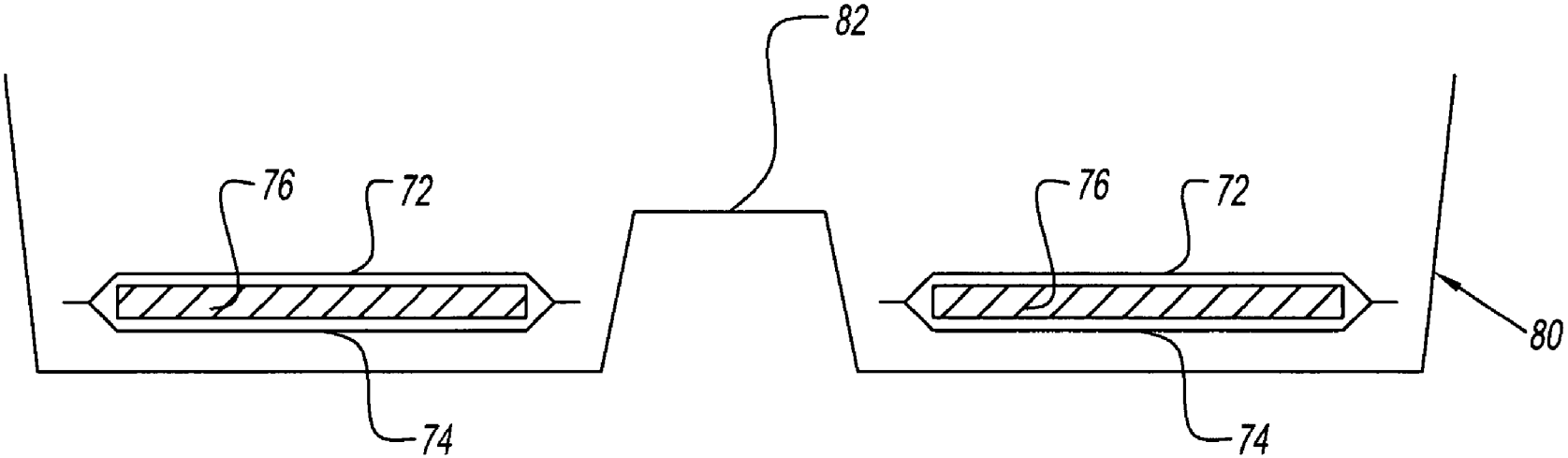
FIG. 6*a* is a side view of a round package with the donut-shaped absorbent pad of FIG. 6 placed in the round package.

Referring to FIGS. 6 and 6*b*, absorbent pad 70, outer layers 72, 74, and absorbent core 76 can also be manufactured with cutout or donut-like shapes. A portion 78 of the absorbent pad can be removed to allow more complex shapes or features, such as perforations and folding lines.

As seen by way of example in FIG. 6*b*, by providing absorbent pad 70 in a donut-like shape, it conveniently fits in a circular or round container 80 having a raised center portion 82.

Figure 7:
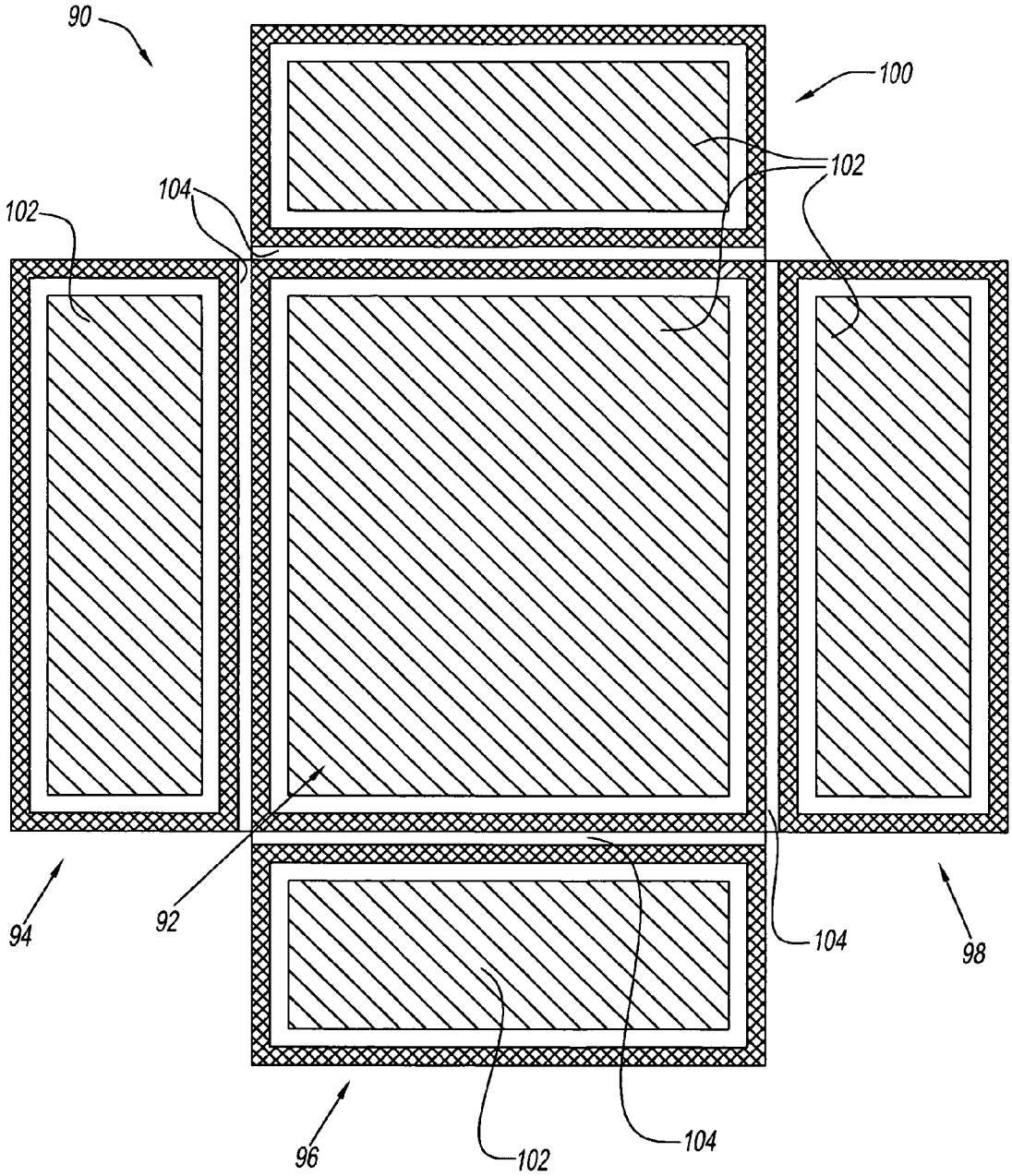
FIG. 7 is top view of an absorbent pad with multiple hinged side panels according to an embodiment of the present invention.

Referring to FIG. 7, particles of the absorbent pad can be removed to allow complex shapes and features, such as folding lines. Absorbent pad 90 has been formed with a main panel 92 and four side panels 94, 96, 98, 100. Main panel 92 and side panels 94, 96, 98, 100 all have absorbent media 102. Each side panel 94, 96, 98, 100 is movably connected to main panel 92 via film connection or hinge 104. Such a configuration allows pad 90 to be placed in a similarly sized container resulting in absorbent pad 90 covering not only the bottom of the container, but also some portion of the four sides of the container. This is particularly advantageous when it is critical that the integrity of both the bottom and sides of the container be maintained.

By utilizing controlled depth die cutting, also known as kiss cutting, several design variations are possible. Kiss cutting allows certain layers in a structure to be cut and then removed while others remain. One design option available is to allow a layer to protrude beyond others. If this layer were an absorbent or cellulosic material and/or allowed wicking along fiber paths, it could be used to acquire fluid and promote flow into the pad. Another option is to heat seal the top and bottom layers intermittently or in a pattern with voids between the sealed areas. These voids form fluid channels from the outside of the sealed areas into the absorbent core structure. If the upper layer were kiss cut at the perimeter of this sealed area, fluid is not allowed to penetrate the lower film as it is intact and is directed into the pad via these fluid channels.

Figure 8:
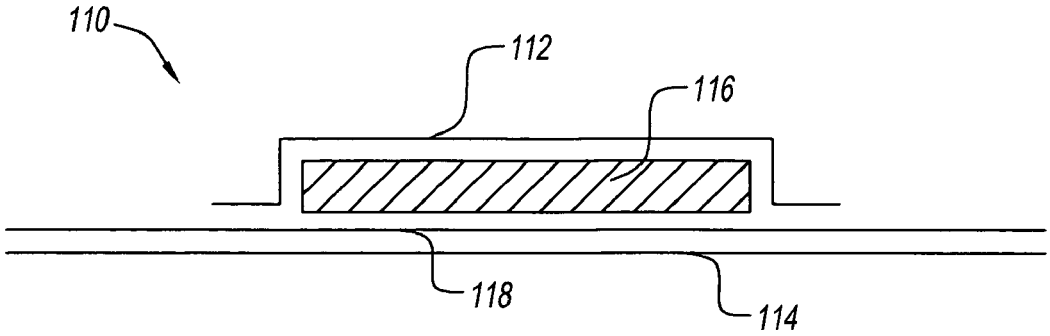
FIG. 8 is a side cut away view of an absorbent pad with a wicking layer that extends beyond the top sheet according to an embodiment of the present invention.

By way of example, referring to FIG. 8, absorbent pad 110 is shown with a top sheet 112, a bottom sheet 114, island 116 and a wicking layer 118 that extends beyond top sheet 112.

Figure 9:
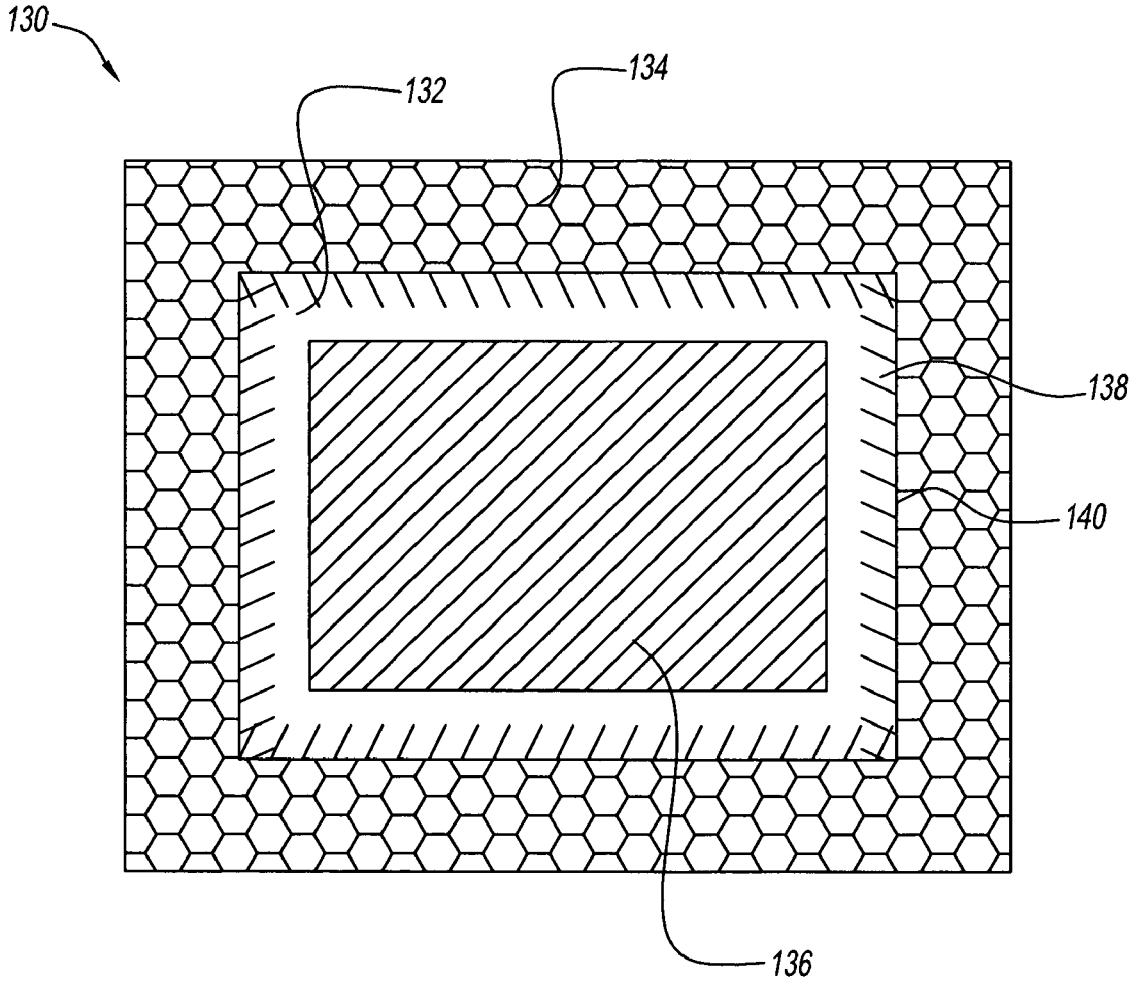
FIG. 9 is a top view of an absorbent pad with a bottom sheet and a wicking sheet that extend beyond the top sheet forming fluid channels according to an embodiment of the present invention.

Again, by way of example, referring to FIG. 9, absorbent pad 130 is shown with top sheet 132, bottom sheet and wicking layer 134 extending beyond top sheet 132 and island 136. An intermittent sealing area 138 is formed, which results in a fluid entry channel 140.

Figure 10:
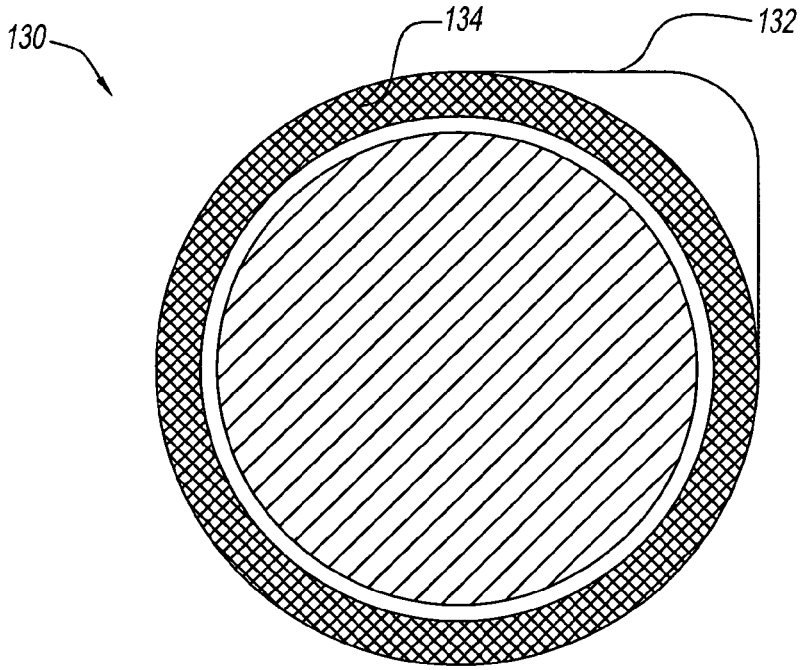
FIG. 10 is a top view of an absorbent pad with a tab extending from the absorbent pad according to an embodiment of the present invention.
Figure 11:
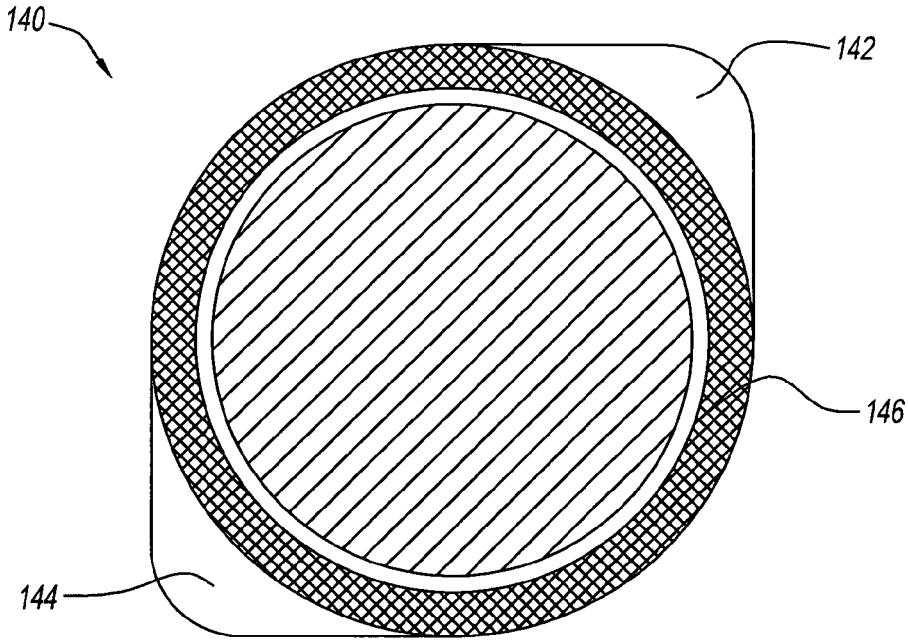
FIG. 11 is a top view of an absorbent pad with two diametrically opposed tabs extending from the absorbent pad according to an embodiment of the present invention.

Pads with layers of different shapes, sizes, and dimensions provide flexibility and improvement in visual, aesthetic, marketing, performance, and package design characteristics of the absorbent pad. Referring to FIGS. 10 and 11, a layer 132, 142, 144 extending from the outer layers 134, 146 of the absorbent pads 130, 140 can be printed with advertising, printed with label information, and have within it an active component. The ability to integrate a layer extending from the outer layers of the absorbent pad into overall food packaging design provides design options that are visual, functional, and performance related.

Rotary dies and vacuum anvils controlled by a customized computer-driven servo drive system allow the cutting and placement of all components necessary to fabricate any one of these unique absorbent pads. Rotary motion, intermittent motion, reciprocal motion, or the combinations of these motions can be used to manufacture various contoured and/or complex shaped absorbent pads. A preferred hybrid combination of rotary motion in an intermittent format with the added utilization of vacuum conveyers provides exemplary results.

An additional advantage to manufacturing the absorbent pads of the present invention is that the waste or matrix cut out around islands can be reclaimed and recycled. This is especially important with the expensive absorbent core material.

The top sheet and bottom sheet of each absorbent pad of the present invention can be sealed together at the edges of the absorbent pad, at the outside of each island or pocket, or at various locations throughout the pad. It has been found that to prevent seam failure that is prevalent in conventional absorbent pads due to the swelling of the absorbent core, proper sealing of the top sheet to the bottom sheet can be obtained through heat, pressure or ultrasonic sealing. These methods provide a solid bond capable of resisting bursting. An embossing, knurling, or point-bonding pattern can be used for even stronger and more flexible bonds than simple flat bonding.

Thermal sealing can provide a strong seam with a minimal amount of material from the top and bottom sheets. Using adhesives to bind the top sheet to the bottom sheet typically requires between about 0.25 inches to about 0.5 inches of material from the top and bottom sheets to create a sufficient seal. However, seals formed by this traditional method are prone to failure when the pad absorbs fluid and exerts stress on the seal. The methods of the present invention provide for strong sealing using only about 0.125 inches to about 0.5 inches of material to create the seams.

It has also been found that to further improve the heat sealing of film, non-woven, or paper layers it is possible for the film to be co-extruded, the non-woven to be bi-component, or the paper to be coated with a low-melt material. Generally, the low-melt materials, such as polymers, are on one side of the layer and are positioned toward the center of the pad. The low-melt materials can be on both layers to be sealed or on only one of the layers. It is preferred that both layers to be sealed have low-melt materials. A preferred co-extruded film is of a high-density polyethylene (HDPE) with an ethylene vinyl acetate (EVA) component on the low-melt side. A preferred thickness for these films is between about 0.0075 inches to about 0.003 inches. The layers can be corona treated to promote ink anchorage and seam bonding. Techniques for sealing the layers include conventional heat/pressure, thermal impulse sealing, radiant surface heat followed by pressure or heat/pressure, ultrasonic sealing, or any combinations thereof. An example of a combination of techniques is ultrasonic sealing preceded by thermal or radiant heat application.

It is possible to register or print the low-melt bond promoter or an adhesive at any point in the pad in any shape or configuration. A rotary or intermittent printing process of any type could be used to achieve this outcome. In high-speed processes, a conventional gravure/doctor blade system was shown effective. For low-melt films or materials, a roll coat/Flexo print device is preferred, although a screen print process is also suitable. Using this device, coatings are generally between about 0.00075 inches to about 0.010 inches in thickness. Some adhesives suitable for use in this printing system include warm and hot melt adhesives, single component (reactive) moisture cure hot melts or liquids, Ultraviolet (UV) cure hot melts or liquids.

One or more of the outer layers of each absorbent pad of the present invention may be perforated to allow for fluid transport across the layer. One method of perforating the materials of the outer layers involves "cold needle" perforation at ambient temperatures. However, holes created with a "cold needle" technique lack a desired three dimensional characteristic that typically add rigidity to the layer, resist closure of the hole, and provide for easy entry but difficult exit of liquid from the absorbent pad. Using either an ultrasonic pattern roll and anvil process, as depicted in FIG. 12*a*, or a hot-needle process, as depicted in FIG. 12*b*, to perforate the layers provides a thermally set hole that resists future movement or closure of the hole.

Figure 12A:
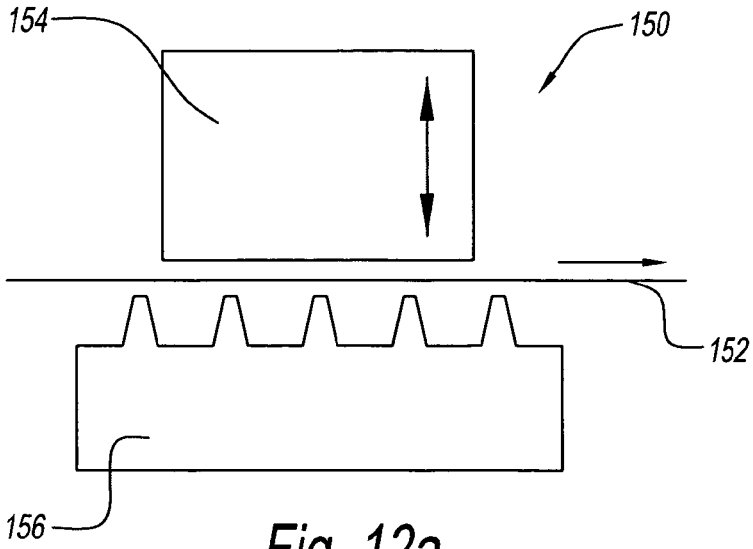
FIG. 12*a* is side view of an ultrasonic perforation apparatus for making an absorbent pad according to an embodiment of the present invention.

Referring to FIG. 12*a*, an ultrasonic apparatus 150 is shown. A sheet of material 152, which can ultimately form either a top sheet or bottom sheet of an absorbent pad according to the present invention is shown traveling horizontally between an ultrasonic horn 154 vibrating vertically and a heated anvil or rotary tool 156.

Figure 12B:
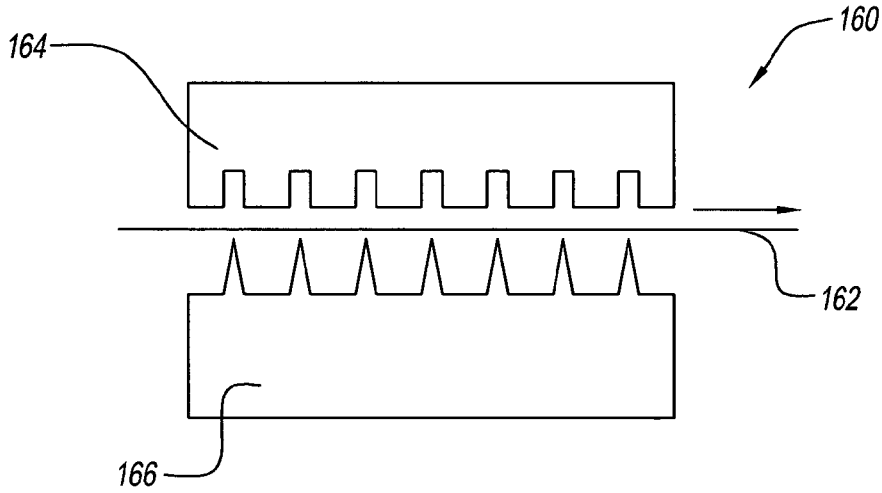
FIG. 12*b* is a side view of a hot needle perforation apparatus for making an absorbent pad according to an embodiment of the present invention.

Referring to FIG. 12*b*, a hot-needle apparatus 160 is shown. A sheet of material 162, which can ultimately form a top sheet and/or bottom sheet of an absorbent pad according to the present invention, is shown traveling horizontally between a female recessed backup roll 164 and a heated pin roll 166.

Figure 13:
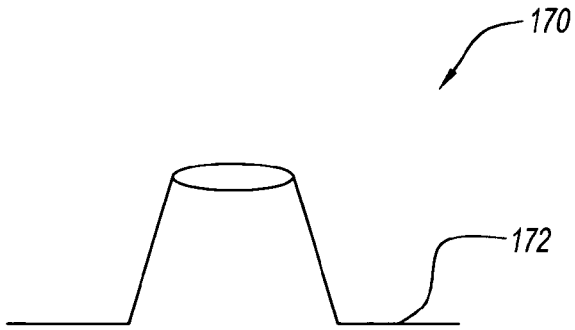
FIG. 13 is a side view of a conical perforation formed on an absorbent pad according to an embodiment of the present invention.

Referring to FIG. 13, by perforating the material used to form the top sheet and/or bottom sheet of the absorbent pad, a conical perforation 170 is formed. Such a conical perforation in a film layer 172 promotes wicking into the absorbent island or core of the absorbent pad and deters absorbed liquid from emanating out of the absorbent pad.

The present invention provides for improved perforation by controlling the design of the perforations to the size and shape of the particular absorbent pad. Conventional perforation covered the entire surface of material used to manufacture the pads. The absorbent pads of the present invention can be perforated in any desired pattern. Perforations that are intentionally random in pattern, such that the holes do not line up substantially in any direction, are preferred where prevention of layer tearing is desired. The layer can be perforated in such a manner that the area to be sealed is left without perforations, target zones for controlled fluid uptake are created, perforations of different shapes and sizes are formed, or any combinations of the foregoing. The perforations can be large window-like holes that directly expose the inner components of the pad, such as an absorbent material, active component, or fluid acquisition/transfer/transport layer. Within the same pad, perforations can vary in pattern and size. Using small holes or micro-perforations (for example smaller than about 0.01 inches) near the center of the pad where the food will come into contact with the pad, can help minimize the desiccation effect, while larger holes near the perimeter will facilitate greater absorption of fluid run-off into the absorbent core.

The absorbent pads of the present invention may also employ static charges to adhere various layers of the absorbent pad together. This improvement over the conventional use of glues and adhesives provides improved product safety via elimination of adhesive components, manufacturing advantages, cost reduction, and product improvement through stronger seal integrity. Using static electricity, typically involving emission of negative ions, the shaped absorbent core material or other internal components can be adhered electrostatically to the top sheet, bottom sheet, or other layer of film, non-woven, or paper material employed in the absorbent pad. This electrostatic adhesion usually occurs prior to the heat-sealing phase. The need for adhesive is thus eliminated. In double and multiple layer island or shaped pads, all layers involved in the island, as well as the outer layers, may be adhered electrostatically.

The static generator can be variable in its power output and can be turned on and off frequently via computer or electronic control. This allows for spot treating the layers with static charge. Spot treatment can prevent application of static charge to areas or materials of the absorbent pad that do not tolerate static or areas where the presence of static is problematic from a manufacturing viewpoint.

Static charge can also be employed in the absorbent pad, typically through positive ion emission, to repel or space apart two materials. This repulsion can be useful in a variety of applications in the absorbent pads of the present invention. Examples of these applications include, but are not limited to: maintaining an opening between two layers, allowing a tab or handle that is formed with the pad to stand away from the other layer for ease of use, and simplifying handling and processing.

The layers of the absorbent pads of the present invention may be corona treated. Corona treatment of film, non-woven, and coated or treated paper surfaces is generally used to promote improved ink anchorage in printing. It has been found that corona treatment of the inside surfaces of film, non-woven, and paper layers in the shaped absorbent pads without adhesives improves adhesion during the heat sealing stage. Not being limited by this theory, it is believed that corona treatment reduces the surface tension.

Corona treatment involves exposing a gas situated in an air gap between an electrode assembly and a treater roll to a very strong electrical field to break down the gas and cause it to lose its insulating capability. During the breakdown, the gas molecules begin to ionize, which enables the gas molecules to become conductive. When a sufficient number of gas molecules have become ionized, a conductive path is generated between the electrodes causing a sudden discharge across the path resulting in a bright flash or arc. A solid dielectric barrier of sufficient material is place between the electrodes to interrupt the conductive path and prevent the arc and the complete breakdown of the gas molecules. This causes, instead of a hot localized arc, a cooler diffuse glow. The soft colored discharge is called a corona and indicates the incomplete breakdown of the gas. Substances to be treated, such as the surfaces of film, non-woven, and paper layers in the shaped absorbent pads of the present invention, are passed into the corona field where it is exposed to the high voltage discharge and the bombardment of high energy particles. The corona field has the ability to break polymer bonds, cause micro-pitting, and deposit an induced surface charge with extremely high levels of strong oxidizing agents onto the substance. Corona treatment can alter the surface characteristics of the substance allowing for enhanced surface adhesion and acceptance of printing inks, adhesives, coatings, and the like. The combination of corona treatment and electrostatic attraction provides for superior pad formation.

It has also been found that the use of specific polymers that offer high elasticity and/or conformity in the outside layers of the absorbent pad provides an absorbent pad with increased ability to expand during the absorption of liquids. High capacity, shaped absorbent pads that conform to specific packaging dimensions must typically expand in a vertical direction. The volume of the cavity or pocket formed by the upper and lower layers of the absorbent pad generally defines the degree of expansion. Conventional cast or blown films or spunbond non-wovens offer very little expansion. A polyurethane, metallocine polyethylene, and block copolymer (synthetic rubber), which can be cast or blown into a film or extruded into a non-woven (spunbond, meltblown, or any combinations thereof) either individually, as a co-extrusion or a bicomponent formation, or in a blend, have been found to provide increased expansion capability over conventional materials.

The absorbent pads of the present invention may be constructed by any method appropriate to result in the unique features of these absorbent pads. In general, raw materials are brought to the processing line in rolls. The materials are converted into the absorbent pads of the present invention. Waste material, such as scrap matrix, are sent either directly to a compactor or recycled depending on the material content. Finished pads are processed in one or more of several ways including: cut into individual pieces and packaged in bulk, connected together with perforations and wound onto a roll or spool for downstream processing, connected together with perforations and placed into a bin or carton for downstream processing, or placed into a tube or magazine for later insertion into a high-speed placement device.

EXAMPLE 1

A top sheet of polyester, polyethylene or other film is co-extruded, laminated, or coated with a low-melt component, such as a polyethylene or a polypropylene blend. A bottom sheet is selected from a high wet strength paper or non-woven fabric. Heat sealing is accomplished with heated rotary tooling that has been engraved with a sealing pattern and recessed pockets to accommodate the thickness of the absorbent core. The gap between the rolls was precisely controlled (to within about 0.0005 inches) and effectively sealed the top and bottom sheets at commercial production speeds of between about 50 fpm and about 500 fpm. Pressure was used to keep the two rolls in position. Generally, the hydraulic pressure on each end of the upper rolls was set at between about 100 psi and about 2000 psi. The design of the sealing pattern, width of the process and materials selected dictate the pressure required.

EXAMPLE 2

An absorbent pad was constructed using a single layer film as the outer layers. The components of this co-extruded single layer film were HDPE and EVA as the low-melt material. The overall thickness of the single layer film was about 1.25 mils (thousands of an inch or about 32 microns). The HDPE component represented about 26 microns while the EVA component represented about 6 microns. This film is used in various thicknesses in many food-packaging applications including cereal box liners. The microperforations in the film were made with hot needle perforation pins in a male/female tooling arrangement. The low-melt sides of the top sheet and bottom sheet, both of the above-described single layer film, were brought together around the inner absorbent core using a set of pattern rolls that were heated to about 270° F. The inner absorbent core was a conventional Airlaid material of cellulose fiber/fluff (about 55%), binder fiber (approximately 15%), and superabsorbent fiber (about 30%). This material is typically made in weights from about 50 gsm to about 500 gsm and is used in many products including absorbent food packaging. In this example absorbent pad the absorbent core ranged from about 140 gsm to about 275 gsm.

EXAMPLE 3

Raw materials are brought to the processing line in rolls. The materials are converted into shaped absorbent pads. The waste materials (scrap matrix) are sent either directly to the compactor or into recycling depending on material content. Finished pads are put-up for processing several ways: cut into individual pieces and packaged in bulk, connected together with perforations and wound onto a roll or spool for downstream processing, connected together with perforations and placed into a bin or carton for downstream processing, and/or placed into a tube or magazine for later insertion to a high-speed placement device.

EXAMPLE 4

An "Active" absorbent pad was constructed using an iron based compound (Mitsubishi "Ageless") that reacts to absorb or scavenge oxygen in the presence of moisture. To protect the iron compound from prematurely reacting, it is encased and protected from atmospheric contact within the pad with a non-perforated film on the top side and a layer of polyvinyl alcohol film (Mono-Sol, LLC) on the lower side. This assembly is positioned as an "island" on top of the airlaid cellulose/SAP absorbent core which has a perforated film layer on the lower surface. The three film layers, (polyethylene, PVA, polyethylene) are all held together with static attraction prior to heat/pressure sealing of the film layers. When placed into use, the fluid being absorbed dissolves the PVA film thereby exposing the iron compound to atmospheric oxygen which is then absorbed or scavenged.

EXAMPLE 5

Another "Active" absorbent pad was constructed using a conventional two-part carbon dioxide releasing system. A pad with an upper island that contained both SAP and calcium carbonate powder (Spectrum) (basic pH) was positioned on top of a lower island that contained SAP and a cellulose component treated with dilute citric acid (Spectrum) (acid pH) and dried. The upper and lower components were separated with a spunbond/meltblown polypropylene nonwoven that maintained physical isolation of the 'active' components prior to being activated by the fluid being absorbed. The entire absorbent structure is covered top and bottom with a conventional film that is perforated on the lower side only and held together via static attraction during assembly. All three layers (polyethylene, nonwoven, polyethylene) are ultrasonically sealed around the perimeter. After becoming moist, the acid component contacts the basic component and carbon dioxide gas is released. The carbon dioxide gas modifies the atmosphere of the food package and serves to retard the growth of bacteria, thus preserving useful product life.

EXAMPLE 6

Another 'active' absorbent pad was constructed using a two-part reactive system that releases Iodine gas as a sanitizer. In this system, Part A, copper sulfate (Spectrum), is dried to remove moisture, mixed with a non-water based fluid, polyethylene glycol, and this mix is used to coat SAP granules in a tumbler for 10-min. These granules were then removed, spread to a weight of 100 gsm and compressed into an absorbent core using pressure and heat with a bonding pattern in a hydraulic press. The Part B component, potassium iodide (Spectrum), is ground into a powder, mixed with polyethylene glycol, coated onto a paper/tissue layer and dried. An absorbent pad is formed with the compressed superabsorbent components placed on top of the treated paper. Film surrounds the entire pad, sealed at the perimeter with perforations in the lower film. The Part A & B 'actives' react when they get wet and mix to release Iodine gas as a powerful oxidizing agent that kills bacteria within the confines of the immediate package.

It should be understood that the foregoing description is only illustrative of the present invention. Various alternatives and modifications can be devised by those skilled in the art without departing from the invention. Accordingly, the present invention is intended to embrace all such alternatives, modifications and variances.

I claim:

1. An absorbent pad for placement in a container comprising: a base panel; one or more side panels comprising a top sheet, a side panel bottom sheet, and one or more islands disposed between said top sheet and said side panel bottom sheet; a hinge, wherein said hinge connects an edge of said base panel to an edge of each of said one or more side panels to provide complete folding of said one or more side panels onto said base panel, wherein said one or more side panels cover at least a portion of a side of the container in which the absorbent pad is placed, and wherein said side panel bottom sheet allows fluid uptake therethrough.

2. The absorbent pad according to claim 1, wherein said one or more side panels are foldable, allowing the absorbent pad to conform to a base and sidewalls of a similarly dimensioned package or container.

3. An absorbent pad for placement in a container comprising:

a base panel, wherein said base panel further comprises a top sheet, a base panel bottom sheet, and one or more islands disposed between said top sheet of said base panel and said base panel bottom sheet;

one or more side panels comprising a top sheet, a side panel bottom sheet, and one or more islands disposed between said top sheet and said side panel bottom sheet;

a hinge, wherein said hinge connects an edge of said base panel to an edge of each of said one or more side panels to provide complete folding of said one or more side panels onto said base panel, wherein said one or more side panels cover at least a portion of a side of the container in which the absorbent pad is placed, and wherein said base panel bottom sheet provides structure for fluid uptake through said base panel bottom sheet.

4. The absorbent pad according to claim 1, wherein said hinge provides a space between said base panel and each of said one or more side panels.

5. The absorbent pad according to claim 1, wherein said hinge is a film connection between said base panel and each of said one or more side panels.

* * * * *